US012071819B2

(12) United States Patent
McCabe et al.

(10) Patent No.: US 12,071,819 B2
(45) Date of Patent: Aug. 27, 2024

(54) SYSTEM AND METHOD FOR HANDLING TOOLS AT A WELLSITE

(71) Applicant: Schlumberger Technology Corporation, Sugar Land, TX (US)

(72) Inventors: Jeffrey Conner McCabe, Sugar Land, TX (US); Rod William Shampine, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/550,034

(22) PCT Filed: Feb. 16, 2022

(86) PCT No.: PCT/US2022/016544
§ 371 (c)(1),
(2) Date: Sep. 11, 2023

(87) PCT Pub. No.: WO2022/191967
PCT Pub. Date: Sep. 15, 2022

(65) Prior Publication Data

US 2024/0044217 A1 Feb. 8, 2024

Related U.S. Application Data

(60) Provisional application No. 63/160,139, filed on Mar. 12, 2021.

(51) Int. Cl.
*E21B 19/15* (2006.01)
*E21B 19/00* (2006.01)
(Continued)

(52) U.S. Cl.
CPC ..... *E21B 19/155* (2013.01); *E21B 19/00* (2013.01); *E21B 19/22* (2013.01); *E21B 19/24* (2013.01)

(58) Field of Classification Search
CPC ..... E21B 19/00; E21B 19/22; E21B 19/24; E21B 19/155
(Continued)

(56) References Cited

U.S. PATENT DOCUMENTS 3,368,699 A * 2/1968 Scaggs ..... E21B 19/155 294/90
3,532,229 A * 10/1970 Scaggs ..... E21B 19/155 414/22.58
(Continued)

FOREIGN PATENT DOCUMENTS

EP 1857402 11/2007

OTHER PUBLICATIONS

PCT International Preliminary Report on Patentability Application No. PCT/US2022/016544; Dated Sep. 21, 2023; 5 pages.
(Continued)

*Primary Examiner* — Tara Schimpf
*Assistant Examiner* — Neel Girish Patel
(74) *Attorney, Agent, or Firm* — Jeffrey D. Frantz

(57) ABSTRACT

A technique facilitates assembly of well equipment at a wellsite. To help lift certain types of well tools, a mounting frame may be releasably coupled to a well string, e.g. a coiled tubing string. A cable guide and a cable attachment member may be releasably coupled to a well tool which is to be moved into engagement with the well string. A cable may be routed from the cable attachment member, through the cable guide, to a cable mounting feature of the mounting frame, and to a winch. The winch is operable to draw in the cable so as to move the well tool into alignment with and up into engagement with a connector of the well string.

20 Claims, 2 Drawing Sheets

(51) Int. Cl.
*E21B 19/22* (2006.01)
*E21B 19/24* (2006.01)

(58) Field of Classification Search
USPC ..... 414/22.54, 22.55, 22.62–22.69, 22.71
See application file for complete search history.

(56) References Cited

U.S. PATENT DOCUMENTS 3,713,547 A * 1/1973 Beck ..... E21B 19/155 414/22.52
3,865,256 A * 2/1975 Freeman, Sr. ..... E21B 19/155 414/22.54
4,024,925 A * 5/1977 Brown ..... E21B 19/155 173/147
4,040,524 A * 8/1977 Lamb ..... E21B 19/155 414/22.52
4,054,210 A * 10/1977 Crocker ..... E21B 19/155 212/72
4,098,532 A 7/1978 Phillips
4,332,411 A 6/1982 Ellzey
5,127,790 A * 7/1992 Teague ..... E21B 19/155 414/22.58
5,857,530 A * 1/1999 Gronseth ..... E21B 7/061 175/45
6,158,516 A * 12/2000 Smith ..... E21B 19/22 175/89
6,612,369 B1 9/2003 Rocha et al.
6,695,559 B1 * 2/2004 Pietras ..... E21B 19/20 414/22.58
2005/0238463 A1 * 10/2005 Smith ..... E21B 19/14 414/22.52
2009/0136326 A1 * 5/2009 Angman ..... E21B 19/155 414/800
2010/0135750 A1 * 6/2010 Tarique ..... E21B 19/20 414/800
2011/0147010 A1 * 6/2011 Ellis ..... E21B 19/07 166/380
2013/0089393 A1 * 4/2013 Guillory, Jr. ..... E21B 19/155 414/800
2013/0272831 A1 10/2013 Duell et al.
2015/0139773 A1 * 5/2015 Nikiforuk ..... B65G 15/24 91/418
2016/0376808 A1 * 12/2016 Magnuson ..... E21B 15/00 52/745.18
2018/0216413 A1 * 8/2018 Fossheim ..... E21B 15/00

OTHER PUBLICATIONS

PCT International Search Report and Written Opinion; Application No. PCT/US2022/016544; Dated May 23, 2022; 8 pages.

* cited by examiner

SYSTEM AND METHOD FOR HANDLING TOOLS AT A WELLSITE

CROSS-REFERENCE TO RELATED APPLICATION

This application is a National Stage Entry of International Patent Application No. PCT/US2022/016544, filed on Feb. 16, 2022, which claims priority to U.S. Provisional Patent Application Ser. No. 63/160,139, filed Mar. 12, 2021, which is incorporated herein by reference in its entirety.

BACKGROUND

In many well applications, various well tools are assembled into a well string at the surface for deployment down into a wellbore. For example, well tools may be assembled into a bottom hole assembly and deployed downhole via coiled tubing. Generally, the individual well tools are lifted and assembled into the well string before being lowered down into the wellbore. However, some well tools may have substantial weight or may otherwise be difficult to handle. This creates complications in lifting such well tools into position for assembly into the well string.

SUMMARY

In general, a system and methodology facilitate assembly of well equipment at a wellsite. To help lift certain types of well tools, a mounting frame may be releasably coupled to a well string, e.g. a coiled tubing string. A cable guide and a cable attachment member may be releasably coupled to a well tool which is to be moved into engagement with the well string. A cable may be routed from the cable attachment member, through the cable guide, to a cable mounting feature of the mounting frame, and to a winch. The winch is operable to draw in the cable so as to move the well tool into alignment with and up into engagement with a connector of the well string.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate assembly of well equipment at a wellsite. A variety of well tools may be heavy and/or awkward to lift into engagement with a well string, e.g. a coiled tubing string. To help lift this type of well tool into engagement with the well string prior to deploying the well tool downhole into a borehole, e.g. a wellbore, a mounting frame may be releasably coupled to the well string. Additionally, a cable guide and a cable attachment member may be releasably coupled to the well tool which is to be moved into engagement with the well string. In this example, a cable is routed from the cable attachment member, through the cable guide, to a cable mounting feature of the mounting frame, and to a winch. The winch is operable to draw in the cable so as to move the well tool into alignment with and up into engagement with a connector, e.g. a coil connector, of the well string.

Figure 1:
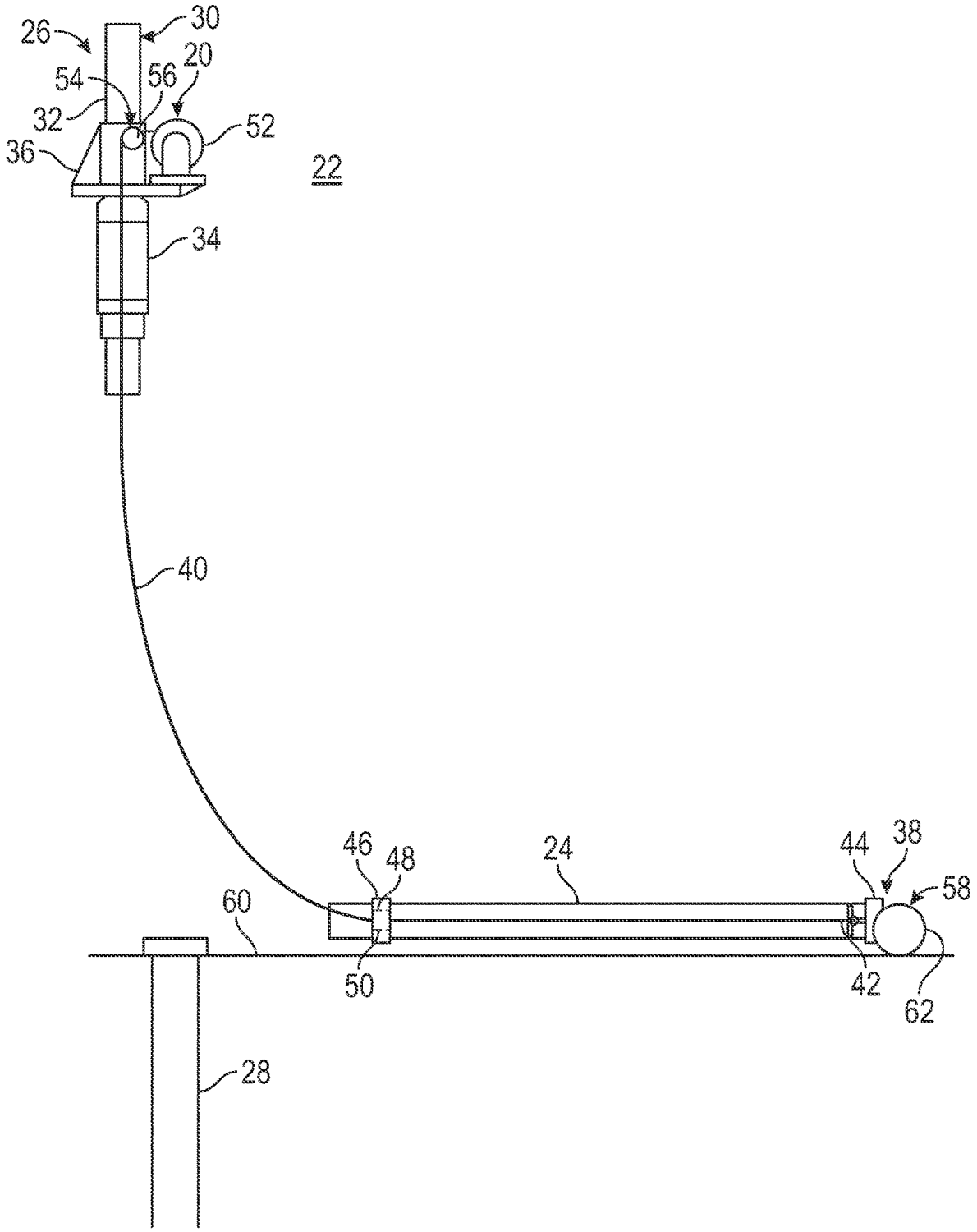
FIG. 1 is a schematic illustration of an example of a system for moving a well tool into position for engagement into a well string at a wellsite, according to an embodiment of the disclosure.

Referring generally to FIG. 1, an example of a well system 20 is illustrated as employed at a wellsite 22 to facilitate assembly of well equipment. In this example, the well equipment may comprise a well tool 24 which is to be lifted into engagement with a well string 26 at a surface location of wellsite 22. It should be noted the well site 22 may be located onshore or offshore depending on the location of a corresponding borehole 28, e.g. wellbore. In the specific example illustrated, well string 26 is in the form of a coiled tubing string 30 having, for example, coiled tubing 32 coupled with a coil connector 34. However, the well system 20 may be utilized with a variety of other types of well strings 26.

In the example illustrated, well system 20 comprises a mounting frame 36 releasably attachable to the well string 26. For example, the mounting frame 36 may be constructed for releasable attachment to the coiled tubing string 30. As illustrated, the mounting frame 36 may be constructed to rest on or otherwise be mounted to an upper end of the coil connector 34. However, the mounting frame 36 may be constructed for releasable mounting to various other components or features of the well string 26. In some embodiments, the mounting frame 36 may be constructed for clamping engagement with a corresponding ridge or groove formed on a component of the coiled tubing string 30 or other type of well string 26.

The mounting frame 36 may be constructed with a plurality of frame sections, e.g. two frame sections, which may be positioned around the coiled tubing 32 and secured together via threaded fasteners or other suitable fasteners. In some embodiments, the frame sections of mounting frame 36 may be pivotably attached to one another for easy opening and closing about the coiled tubing 32 or other component or feature of well string 26. Once the frame sections of mounting frame 36 are closed about the corresponding feature of well string 26, the frame sections of mounting frame 36 may be secured together via suitable threaded fasteners, latches, or other appropriate fasteners. The mounting frame 36 may be sized to enable rotation of the mounting frame 36 about the well string 26/coiled tubing 32 to facilitate rotational alignment of well tool 24 with the well string 26, e.g. with coil connector 34.

With additional reference to FIG. 1, the well system 20 also may comprise a cable attachment member 38 to which a winch cable 40 may be attached. For example, a distal end 42 of the winch cable 40 may be connected to the cable attachment member 38 via a hook or other suitable connector. Additionally, the cable attachment member 38 may be releasably coupled to the downhole well tool 24 by fasteners, latches, or other fastening mechanisms. The cable attachment member 38 may be in the form of a collar 44 having collar sections releasably connected or pivotably connected to each other to enable clamping of the collar about the outer surface of well tool 24. In the embodiment illustrated, the cable attachment member 38 is releasably coupled to the well tool 24 at a lower or downhole end of the well tool 24 although the cable attachment member 38 may be mounted at other locations along the well tool 24.

It should be noted the winch cable 40 may be constructed in various forms and from various materials. For example, the winch cable 40 may be made from metal materials, non-metal materials, or various composite materials. Additionally, the winch cable 40 may be constructed as a single-strand or a multi-strand cable of suitable sizes to lift many types of well tools 24 having various weights.

The well system 20 also may comprise a cable guide 46 which may be releasably coupled to the downhole well tool 24 by suitable fasteners, latches, or other fastening mechanisms. The cable guide 46 may be in the form of a cable guide collar 48 having collar sections releasably connected or pivotably connected to each other to enable clamping of the collar 48 about the outer surface of well tool 24. In the embodiment illustrated, the cable guide 46 is releasably coupled to the well tool 24 at an upper or uphole end of the well tool 24 although the cable guide 46 may be mounted at other locations along the well tool 24. By way of example, the cable guide 46 and the cable attachment member 38 may generally be mounted at opposite ends of the well tool 24. In some embodiments, the cable guide 46 may have a suitable opening 50 through which the winch cable 40 is slidably received therethrough.

According to the embodiment illustrated, the well system 20 also comprises a winch 52 which is coupled to the winch cable 40. The winch 52 may be selectively operated to wind up the winch cable 40 or to release, i.e. spool out, the winch cable 40. As illustrated, the winch cable 40 is routed from the cable attachment member 38, through the cable guide 46, to a cable mounting feature 54 of mounting frame 36, and to the winch 52. In the example illustrated, the cable mounting feature 54 is in the form of a pulley 56, e.g. a cable alignment pulley, over which the winch cable 40 moves during operation of winch 52. The pulley 56 or other type of cable mounting feature 54 may be positioned to help align the well tool 24 with the coiled tubing string 30 (or other well string 26) as the winch 52 is operated to draw the well tool 24 up into engagement with, for example, the coil connector 34 of coiled tubing string 30.

By way of example, the winch 52 may be in the form of a worm drive winch which is electrically powered to selectively wind up or spool out the winch cable 40. However, winch 52 may comprise other types of winches which are electrically powered, pneumatically powered, hydraulically powered, or otherwise powered. In some applications, the winch 52 may be hand powered via a suitable handcrank or other operator. Additionally, the winch 52 may be positioned at various wellsite locations. In the illustrated example, the winch 52 is mounted directly on the mounting frame 36.

As further illustrated in FIG. 1, the well system 20 comprises a transition member 58 releasably coupled to the downhole well tool 24. The transition member 58 is constructed to facilitate transition of the well tool 24 across a surface 60 as the well tool 24 is moved toward engagement with the well string 26, e.g. the coiled tubing string 30, via the winch 52. For example, the transition member 58 facilitates lateral movement of the well tool 24 as the well tool 24 is drawn from a lateral position along surface 60 (see FIG. 1) to a generally vertical position beneath the well string 26, e.g. beneath coil connector 34 of coiled tubing string 30 (see FIG. 2). Surface 60 may be the surface of an offshore facility, an onshore facility, a ground surface, or another type of lateral surface on which the well tool 24 is initially positioned.

The transition member 58 may be constructed in a variety of forms depending on the parameters of a given well operation. By way of example, the transition member 58 may comprise a wheel 62 positioned to help the well tool 24 transition to the engagement position by rolling across surface 60 until well tool 24 is suspended. In some embodiments, the wheel 62 may be in the form of a plurality of wheels positioned side-by-side or at different locations along well tool 24.

However, the transition member 58 also may comprise rollers, sliders, sacrificial components, or other types of components able to help transition the well tool 24 along surface 60 without damaging the well tool 24. In the illustrated example, the transition member 58 is positioned proximate cable attachment member 38 at a lower or downhole end of the well tool 24. However, the transition member 58 may be located at other positions along well tool 24 or at multiple positions along well tool 24. The transition member 58 also can be integrally formed with cable attachment member 38 or constructed as an entirely separate component from cable attachment member 38.

In an operational example, the mounting frame 36 is releasably coupled to the coiled tubing string 30 or other type of well string 26. For example, the mounting frame 36 may be releasably coupled along the top of coil connector 34 in a manner which allows rotation of the mounting frame 36 about coiled tubing 32 to a desired rotational position. Additionally, the cable guide 46 and the cable attachment member 38 are releasably connected to the well tool 24. In some embodiments, the transition member 58, e.g. at least one wheel 62, also is releasably mounted to the well tool 24. In this operational example, the winch 52 is secured to the mounting frame 36. The winch cable 40 is routed through opening 50 of cable guide 46 and secured to the cable attachment member 38. Consequently, the cable 40 is effectively routed from the cable attachment member 38, through the cable guide 46, to the cable mounting feature 54, and to the winch 52. For example, the cable 40 may be routed over pulley 56 which facilitates movement of cable 40 and alignment of well tool 24 during operation of winch 52.

Figure 2:
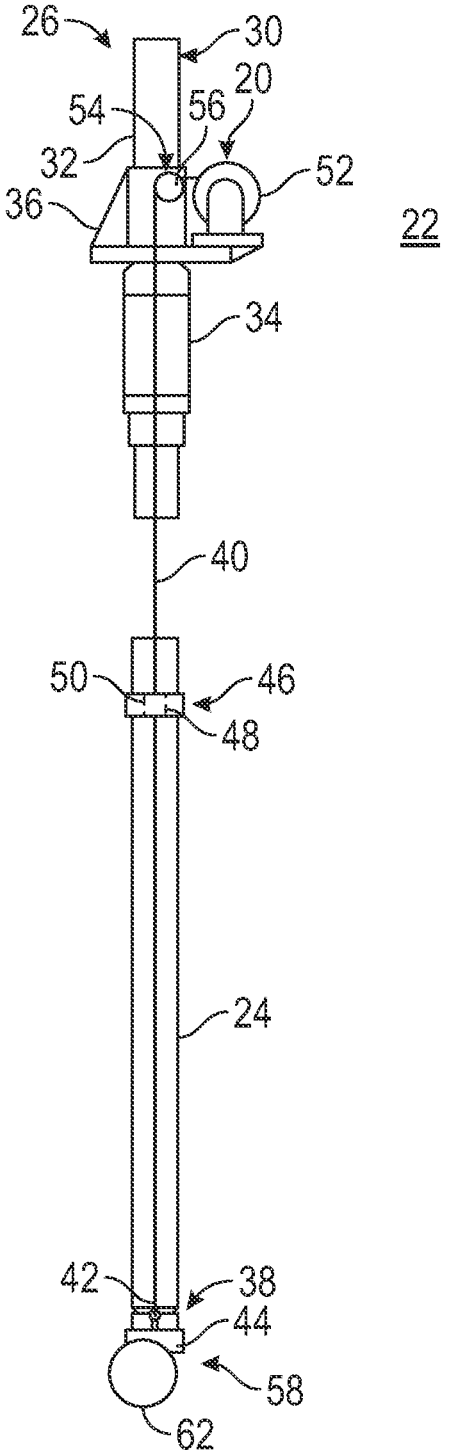
FIG. 2 is a schematic illustration of the well tool suspended below a well string connector during assembly into the well string, according to an embodiment of the disclosure.

Once winch cable 40 is appropriately routed between winch 52 and cable attachment member 38 as illustrated in FIG. 1, the winch 52 may be operated to wind up winch cable 40. As the cable 40 is drawn in via winch 52, the well tool 24 is drawn laterally along surface 60. This lateral movement of well tool 24 is facilitated via the transition member 58 to ensure the well tool 24 is protected against damage. The winch 52 is continually operated to move the well tool 24 into a generally vertical position beneath well string 26, as illustrated in FIG. 2. In the specific example illustrated, the well tool 24 is transitioned to a vertical position beneath coil connector 34. Continued operation of winch 52 draws the well tool 24 into engagement with coil connector 34 so that well tool 24 may be secured into the coiled tubing string 30.

After securing the well tool 24 into the coiled tubing string 30 (or other well string 26), the well system 20 may be removed. For example, the transition member 58, cable attachment member 38, and cable guide 46 may be removed from well tool 24. Similarly, the mounting frame 36, and thus winch 52 along with winch cable 40, may be released and removed from the coiled tubing string 30. The well tool 24 may then be lowered down into wellbore 28 by unspooling the coiled tubing 32 according to, for example, a conventional coiled tubing deployment operation.

Depending on the parameters of a given environment and/or well string deployment operation, the size, configuration, and location of various components of well system 20 may be adjusted. For example, the mounting frame 36 may have various configurations and mounting features to facilitate mounting to various components and at various locations along the well string 26. Similarly, the cable attachment member 38 and cable guide 46 may have various releasable attachment mechanisms and may be positioned at various locations along well tool 24. In some embodiments, the cable attachment member 38 and cable guide 46 may simply be clamped to the well tool 24 while in other applications they may be secured to corresponding attachment features positioned along well tool 24.

Additionally, the winch 52 may comprise various types of winches powered via different energy sources. The winch 52 may be mounted directly to mounting frame 36 or it may be positioned at other suitable locations of wellsite 22. The transition member 58 also may have various forms and configurations to facilitate use of the winch 52 in transitioning the well tool 24 from a generally lateral position along surface 60 to an engagement position beneath the well string 26. The winch cable 40 also may be made from various materials and in various configurations to facilitate the lifting and/or alignment of well tool 24 during connection of the well tool 24 into the well string 26.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for facilitating assembly of well equipment at a wellsite, comprising:

a mounting frame releasably attachable to a coiled tubing string;

a winch cable movably engaged with the mounting frame via a cable mounting feature;

a winch coupled to the winch cable to selectively windup and release the winch cable;

a cable guide releasably attachable to a well tool, the cable guide slidably receiving the winch cable therethrough;

a cable attachment member releasably attachable to the well tool, the cable attachment member also being connectable to a distal axial end of the winch cable; and at least one wheel releasably attachable directly to the well tool, wherein the at least one wheel is configured to support and move the well tool while rolling along a ground surface of the wellsite.

2. The system as recited in claim 1, wherein the cable mounting feature is positioned to help align the well tool with the coiled tubing string as the winch is operated to draw the well tool up into engagement with the coiled tubing string.

3. The system as recited in claim 1, wherein the cable mounting feature comprises a pulley.

4. The system as recited in claim 1, further comprising a transition member releasably coupleable to the well tool to facilitate transition of the well tool across the ground surface as the well tool is moved laterally toward a position of alignment with the coiled tubing string via the winch, wherein the transition member comprises the at least one wheel.

5. The system as recited in claim 1, wherein the winch cable is configured to extend from the winch, through an opening in the cable guide of the well tool, and lengthwise along an axis of the well tool to the cable attachment member, and wherein the winch cable terminates at the cable attachment member.

6. The system as recited in claim 1, wherein the winch is mounted on the mounting frame.

7. The system as recited in claim 1, wherein the mounting frame is releasably attachable to the coiled tubing string directly above a coil connector coupled to coiled tubing of the coiled tubing string.

8. The system as recited in claim 1, wherein the at least one wheel and the cable attachment member are directly coupled to the well tool proximate each other.

9. The system as recited in claim 8, wherein the at least one wheel and the cable attachment member are directly coupled to the well tool at a common end portion of the well tool.

10. A method, comprising:

releasably coupling a mounting frame to a well string;

releasably connecting a cable guide and a cable attachment member to a well tool;

routing a cable from the cable attachment member, through the cable guide, to a cable mounting feature of the mounting frame, and to a winch, wherein the cable attachment member is coupled to a distal axial end of the cable;

releasably attaching at least one wheel directly to the well tool;

rolling the at least one wheel along a ground surface of a wellsite to support and move the well tool; and operating the winch to move the well tool into alignment with and up into engagement with a connector of the well string.

11. The method as recited in claim 10, further comprising releasably mounting a transition member to the well tool to facilitate transition of the well tool from a lateral position to a vertical position beneath the connector, wherein the transition member comprises the at least one wheel.

12. The method as recited in claim 11, wherein routing the cable comprises extending the cable from the winch, through an opening in the cable guide of the well tool, and lengthwise along an axis of the well tool to the cable attachment member, and wherein the cable terminates at the cable attachment member.

13. The method as recited in claim 11, further comprising connecting the well tool to the connector; and releasing the transition member, the cable attachment member, the cable guide, and the mounting frame so as to facilitate movement of the well tool downhole into a wellbore.

14. The method as recited in claim 10, further comprising mounting the winch to the mounting frame.

15. The method as recited in claim 10, wherein releasably connecting comprises connecting the cable guide and the cable attachment member to generally opposite ends of the well tool.

16. The method as recited in claim 10, wherein releasably coupling the mounting frame to the well string comprises coupling the mounting frame to a coiled tubing string.

17. A system for facilitating assembly of well equipment at a wellsite, comprising:

a mounting frame releasably attachable to a well string;

a winch cable movably engaged with the mounting frame via a cable mounting feature;

a winch coupled to the winch cable to selectively windup and release the winch cable;

a cable attachment member releasably attachable to a well tool, the cable attachment member also being connectable to a distal axial end of the winch cable; and a transition member comprising at least one wheel releasably coupleable directly to the well tool to facilitate transition of the well tool across a ground surface as the well tool is moved laterally toward a position of alignment with the well string via the winch, wherein the at least one wheel is configured to support and move the well tool while rolling along the ground surface of the wellsite.

18. The system as recited in claim 17, wherein the winch cable is configured to extend from the winch, through an opening in a cable guide releasably attachable to the well tool, and lengthwise along an axis of the well tool to the cable attachment member, and wherein the cable terminates at the cable attachment member.

19. The system as recited in claim 17, wherein the cable attachment member and the transition member are combined to enable collective attachment and release with respect to the well tool.

20. The system as recited in claim 17, wherein the well string comprises a coiled tubing string.

* * * * *